US011254556B2

(12) United States Patent
Juarez

(10) Patent No.: US 11,254,556 B2
(45) Date of Patent: Feb. 22, 2022

(54) ROPE HALTER CONVERSION ATTACHMENT FOR BITLESS RIDING

(71) Applicant: Martin Juarez, Oxnard, CA (US)

(72) Inventor: Martin Juarez, Oxnard, CA (US)

( * ) Notice: Subject to any disclaimer, the term of this patent is extended or adjusted under 35 U.S.C. 154(b) by 114 days.

(21) Appl. No.: 16/859,404

(22) Filed: Apr. 27, 2020

(65) Prior Publication Data

US 2021/0331910 A1 Oct. 28, 2021

(51) Int. Cl.
*B68B 1/02* (2006.01)

(52) U.S. Cl.
CPC ..... *B68B 1/02* (2013.01)

(58) Field of Classification Search
CPC ..... B68B 1/02; B68B 1/04; B68B 2001/042
See application file for complete search history.

(56) References Cited

U.S. PATENT DOCUMENTS 278,988 A 6/1883 Massey
1,232,308 A * 7/1917 Higgins ..... B68B 1/02 54/24
1,478,958 A * 12/1923 Heien ..... B68B 1/04 54/6.1
2,186,350 A * 1/1940 Simon ..... B68B 1/06 54/6.1
2,469,046 A * 5/1949 Laws ..... B68B 1/06 54/6.1
2,597,736 A * 5/1952 Jones ..... B68B 1/04 54/6.1
4,459,795 A * 7/1984 Le Tixerant ..... B68B 1/04 54/24
6,591,589 B2 7/2003 Cook
7,373,766 B1 5/2008 Watkins
9,181,079 B2 * 11/2015 Gaudet ..... B68B 1/06
2014/0190133 A1 7/2014 Drumm

FOREIGN PATENT DOCUMENTS

EP 2120537 B1 6/2010
GB 190612287 A * 10/1906 ..... B68B 1/04

* cited by examiner

*Primary Examiner* — Monica L Barlow
*Assistant Examiner* — Madeline L Douglas
(74) *Attorney, Agent, or Firm* — Lyon & Harr, LLP; Richard T. Lyon

(57) ABSTRACT

A rope halter conversion attachment that attaches reins to a rope halter fitted to a horse's head to create a bitless bridle which allows a rider to communicate commands to the horse via the rope halter by manipulation of the reins. To accomplish this task, the rope halter conversion attachment forms an angle between the halter's cheek knot and the point of attachment of the reins. When rein tension is applied by the rider, this angle causes a pivoting motion at the halter's cheek knot that pulls on the nose band and creates pressure on the horse's nose. The pressure communicates nonverbal commands to the horse.

17 Claims, 11 Drawing Sheets

ROPE HALTER CONVERSION ATTACHMENT FOR BITLESS RIDING

BACKGROUND

Horseback riding has long been a part of human civilization. For work or pleasure horseback riding continues to be important economically and is cross cultural. In 2018 the equine industry in the United States generated approximately $122 billion in total economic impact. The current number of horses in the United States is approximately 7.2 million. There are 3.1 million horses owed for recreation, 1.2 million horses competing in shows and half a million horses working in the United States, Europe, and countries worldwide.

Horses are traditionally ridden with equipment called tack. There are two general styles referred to as English and Western. The tack typically includes a saddle and a bridle. The bridle normally has a piece of metal in the horse's mouth called a bit. The bit allows precise communication of the rider to the horse in activities such as working cattle or competing in sports events. In upper level competition, such as the Olympics and the World Cup, a double bridle which has two bits is required. The horse goes through a training process to accustom the animal to the bridle, bit, and other parts of the tack, as well as the commands of the rider.

Communication with horses is usually nonverbal. The horse is taught that gentle pressure on a certain part of the body is a request to move in a certain way. At the beginning of the training process and throughout its life, the horse is usually trained while tethered to a rope halter. The rope halter can be made with knots placed in specific locations (i.e., pressure points) to precisely, gently, and nonverbally communicate. It is noted that despite the name, the rope halter need not be made of rope. Rather, it can also be made of other materials such a plastic cord, leather straps, and so on. As the training progresses, the horse is taught to accept the traditional bridle and bit. Whether English style or Western, as the horse reaches the upper levels of training, such as Olympic dressage competition and International Western riding events, they have learned to use a bit with a metal extension called a shank. The shank attachment to the bit, although harsh sounding in name, is quite humane and as stated before is even required at upper levels of competition. The shank, by creating leverage, allows the rider to communicate to the horse a specific body position or movement (e.g., head down, neck and back arched, shortened steps, and so on).

SUMMARY

This Summary is provided to introduce a selection of concepts, in a simplified form, that are further described hereafter in the Detailed Description. This Summary is not intended to identify key features or essential features of the claimed subject matter, nor is it intended to be used as an aid in determining the scope of the claimed subject matter.

Rope halter conversion attachment implementations described herein generally involve a rope halter conversion attachment for attaching reins to a rope halter fitted on the head of a riding animal in a way that allows a rider to communicate a nonverbal command to the animal by applying tension to the reins. In one implementation, the rope halter conversion attachment includes a cheek knot capture portion that captures a cheek knot on the rope halter formed at the juncture of a nose band and a cheek piece. There is also a lever portion that extends away from the cheek knot capture portion at a prescribed angle, and a rein attachment portion that extends away from a distal end of the lever portion. The rein attachment portion is used to connect the reins to the rope halter conversion attachment. Whenever tension is applied to the reins, the rope halter conversion attachment pivots, pulling on the nose band and applying pressure on top of the nose of the animal thereby communicating a nonverbal command to the animal.

In another implementation, the rope halter conversion attachment includes a cheek knot capture portion that includes a cheek knot capture slot which captures the cheek knot on the rope halter formed at the juncture of the nose band and cheek piece whenever the rope halter conversion attachment is folded over the cheek knot. A releasable connector holds an inward facing part of the cheek knot capture portion to an outward facing part of the cheek knot capture portion whenever the rope halter conversion attachment is folded over the cheek knot. In addition, an inward facing lever portion is included that extends away from the inward facing part of the cheek knot capture portion at a prescribed angle, and an outward facing lever portion is included that extends away from the outward facing part of the cheek knot capture portion at the prescribed angle. Whenever the rope halter conversion attachment is folded over the cheek knot, the inward and outward facing lever portions align with each other and together point toward to bottom of the animal's mandible. Further, the rope halter conversion attachment includes an inward facing rein attachment portion that extends away from a distal end of the inward facing lever portion, and an outward facing rein attachment portion that extends away from a distal end of the outward facing lever portion. Whenever the rope halter conversion attachment is folded over the cheek knot, the inward and outward facing rein attachment portions align with each other and are used to connect the reins to the rope halter conversion attachment.

In a rope halter conversion attachment system for attaching reins to a rope halter fitted on the head of a riding animal in a way that allows a rider to communicate a nonverbal command to the animal by applying tension to the reins, the system includes a left-side rope halter conversion attachment which attaches to the halter on the left side of the animal's face, and a right-side rope halter conversion attachment which attaches to the halter on the right side of the animal's face. The left-side rope halter conversion attachment is a mirror image copy of the right-side rope halter conversion attachment. Each rope halter conversion attachment includes a cheek knot capture portion that captures the cheek knot on the rope halter formed at the juncture of the nose band and the cheek piece. Each rope halter conversion attachment also includes a lever portion which extends away from the cheek knot capture portion at a prescribed angle, and a rein attachment portion that extends away from a distal end of the lever portion. The rein attachment portion is used to connect the reins to the rope halter conversion attachment. Whenever tension is applied to the reins, the left-side and right-side rope halter conversion attachments create a pivoting motion at each cheek knot. This motion pulls on the nose band and applies pressure on top of the nose of the animal, thereby communicating a nonverbal command to the animal.

DESCRIPTION OF THE DRAWINGS

The specific features, aspects, and advantages of the rope halter conversion attachment implementations described herein will become better understood with regard to the following description, appended claims, and accompanying drawings where:

DETAILED DESCRIPTION

Figure 1:
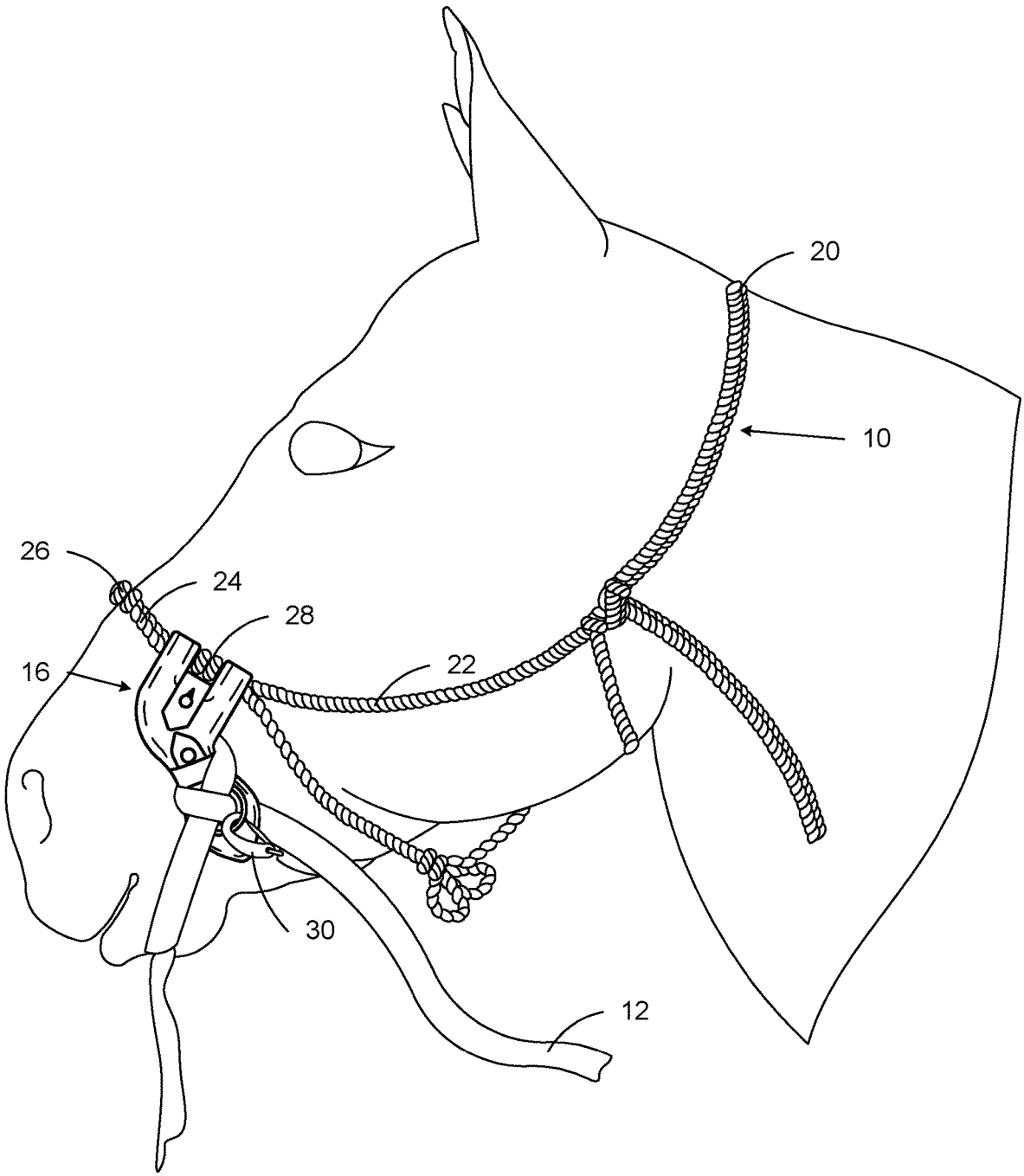
FIG. 1 is a diagram illustrating an exemplary implementation, in simplified form, of a left-side rope halter conversion attachment installed onto a rope halter that is fitted on a horse's head, where the rope halter conversion attachment includes a rein attachment portion resembling a Western style bridle slobber strap and where there is no tension being placed on the mecate style reins.

In the following description reference is made to the accompanying drawings which form a part hereof, and in which are shown, by way of illustration, specific implementations in which a rope halter conversion attachment for bitless riding (rope halter conversion attachment for short) can be practiced. It is understood that other implementations can be utilized and structural changes can be made without departing from the scope of the rope halter conversion attachment.

It is also noted that for the sake of clarity specific terminology will be resorted to in describing the rope halter conversion attachment implementations described herein and it is not intended for these implementations to be limited to the specific terms so chosen. Furthermore, it is to be understood that each specific term includes all its technical equivalents that operate in a broadly similar manner to achieve a similar purpose. Reference herein to "one implementation", or "another implementation", or an "exemplary implementation", or an "alternate implementation", or "some implementations", or "one tested implementation"; or "one version", or "another version", or an "exemplary version", or an "alternate version", or "some versions", or "one tested version"; or "one variant", or "another variant", or an "exemplary variant", or an "alternate variant", or "some variants", or "one tested variant"; means that a particular feature, a particular structure, or particular characteristics described in connection with the implementation/version/variant can be included in one or more implementations of the rope halter conversion attachment. The appearances of the phrases "in one implementation", "in another implementation", "in an exemplary implementation", "in an alternate implementation", "in some implementations", "in one tested implementation"; "in one version", "in another version", "in an exemplary version", "in an alternate version", "in some versions", "in one tested version"; "in one variant", "in another variant", "in an exemplary variant", "in an alternate variant", "in some variants" and "in one tested variant"; in various places in the specification are not necessarily all referring to the same implementation/version/variant, nor are separate or alternative implementations/versions/variants mutually exclusive of other implementations/versions/variants. Yet furthermore, the order of a process flow representing the operations of one or more implementations, or versions, or variants does not inherently indicate any particular order nor imply any limitations of the rope halter conversion attachment.

Furthermore, to the extent that the terms "includes," "including," "has," "contains," and variants thereof, and other similar words are used in either this detailed description or the claims, these terms are intended to be inclusive, in a manner similar to the term "comprising", as an open transition word without precluding any additional or other elements.

1.0 Introduction

In general, the rope halter conversion attachment implementations described herein are employed to attach reins to a rope halter. This creates a bitless bridle, and allows a rider to better communicate commands to a horse. It is noted that while the following description is directed to horses, the rope halter conversion attachment implementations described herein can also be used with other riding animals such as mules, ponies, and so on.

While a horse is typically ridden using the previously described bridle and bit, bitless riding is desirable in many situations. For example, it is advantageous to teach a horse basic positions and movements, such as turning, stopping and backing up, early in its training before it has learned to wear a bridle and bit. In addition, the equestrian community is becoming increasingly empathetic to the comfort and humane treatment of their animals and is seeking alternative means of control during riding, in ways that are painless and noninvasive compared to a traditional tack employing bridles and bits. For example, it is not desirable to use a bit when the horse has a sore mouth or teeth. Further, when a horse's work is less demanding, such as trail riding, it is advantageous for a horse to be ridden bitless so that it can be allowed to graze or be tethered along the way.

Figure 5:
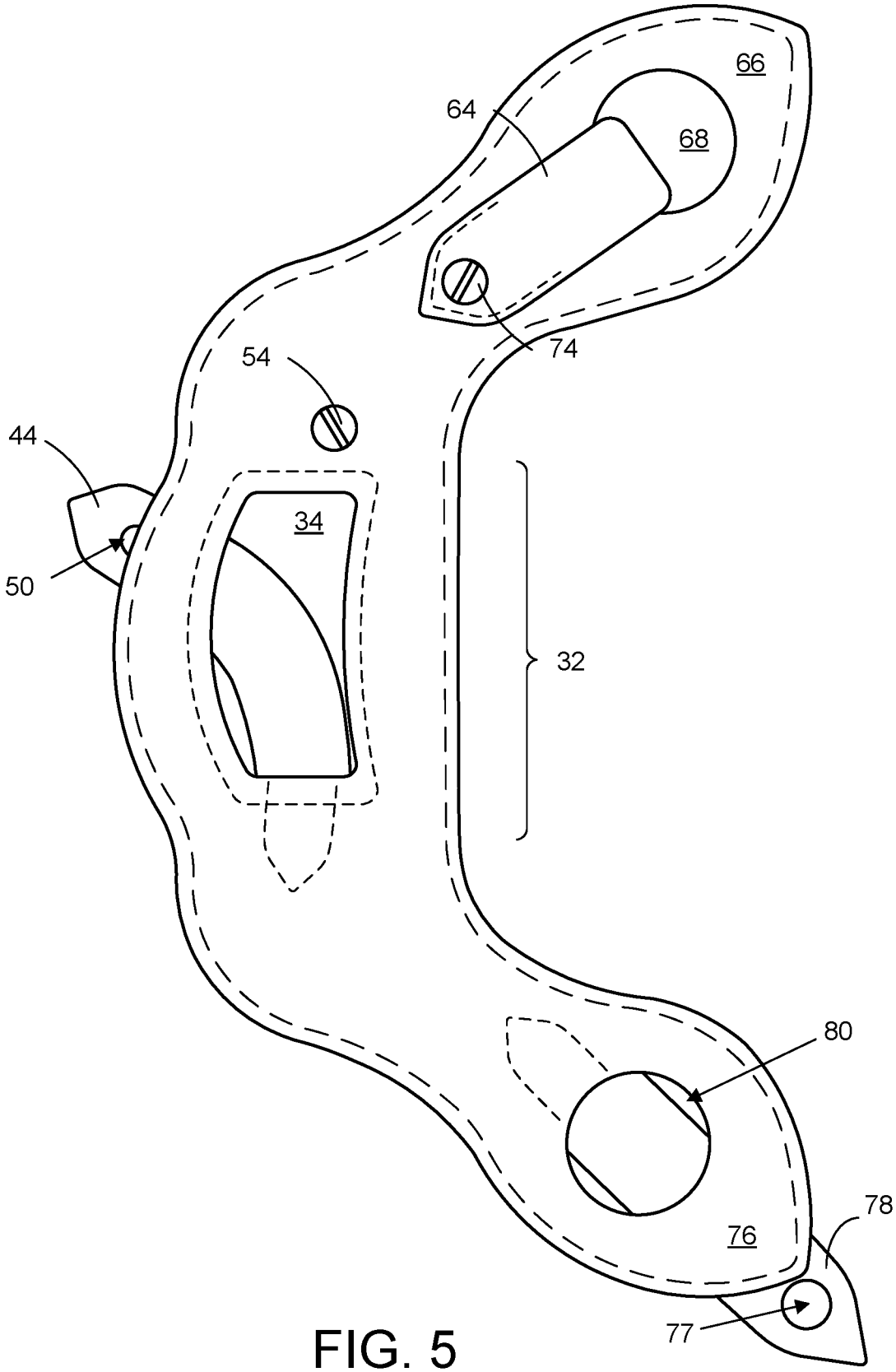
FIG. 5 is a diagram illustrating one implementation, in simplified form, of the left-side rope halter conversion attachment with the rein attachment portion resembling a Western style bridle slobber strap and showing its back side in the unfolded condition.
Figure 6:
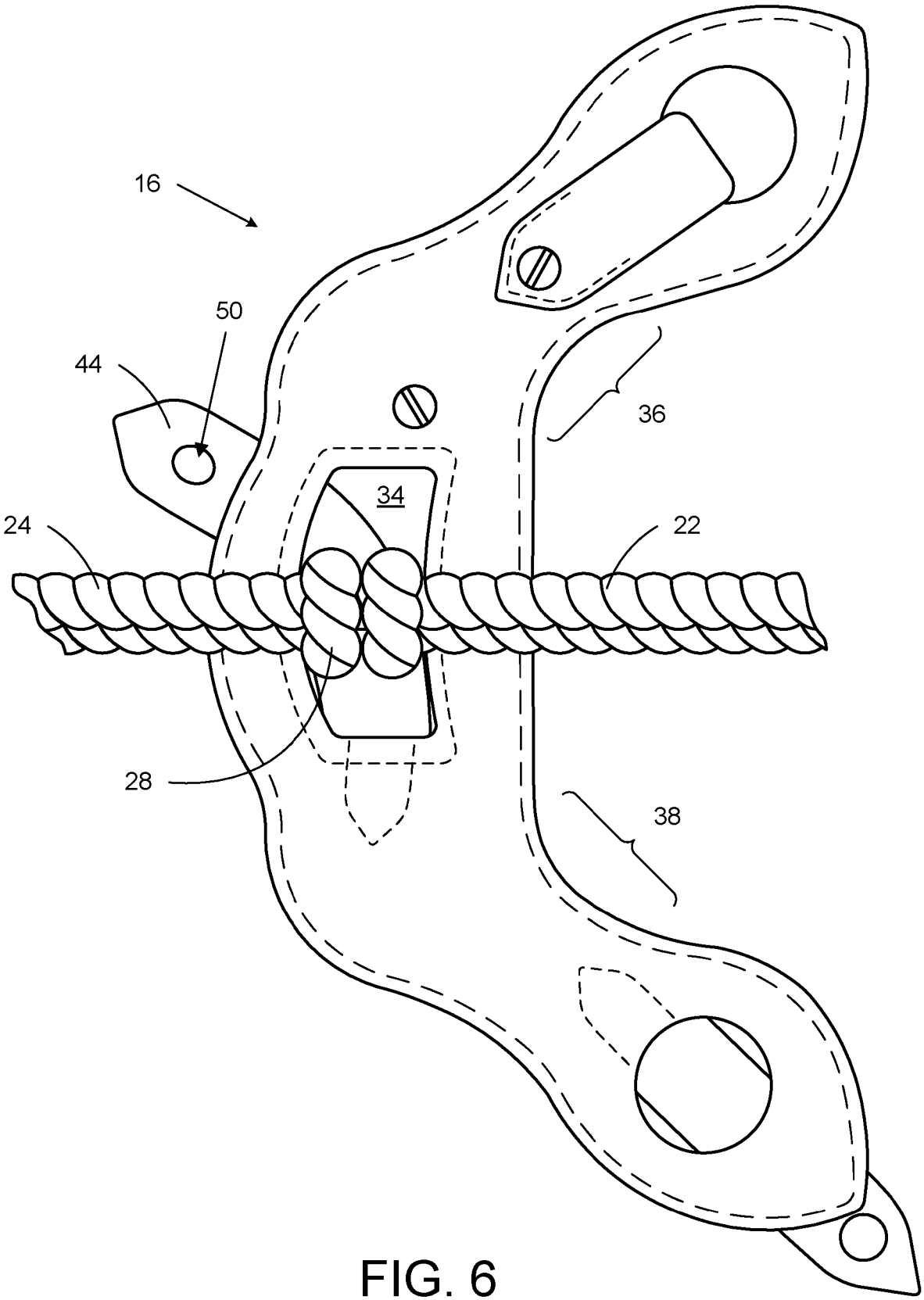
FIG. 6 is a diagram illustrating one implementation, in simplified form, of the left-side rope halter conversion attachment with the rein attachment portion resembling a Western style bridle slobber strap and showing its back side in the unfolded condition placed under the cheek piece and nose band of the rope halter with the halter's cheek knot in the rope halter conversion attachment's cheek knot slot.
Figure 7:
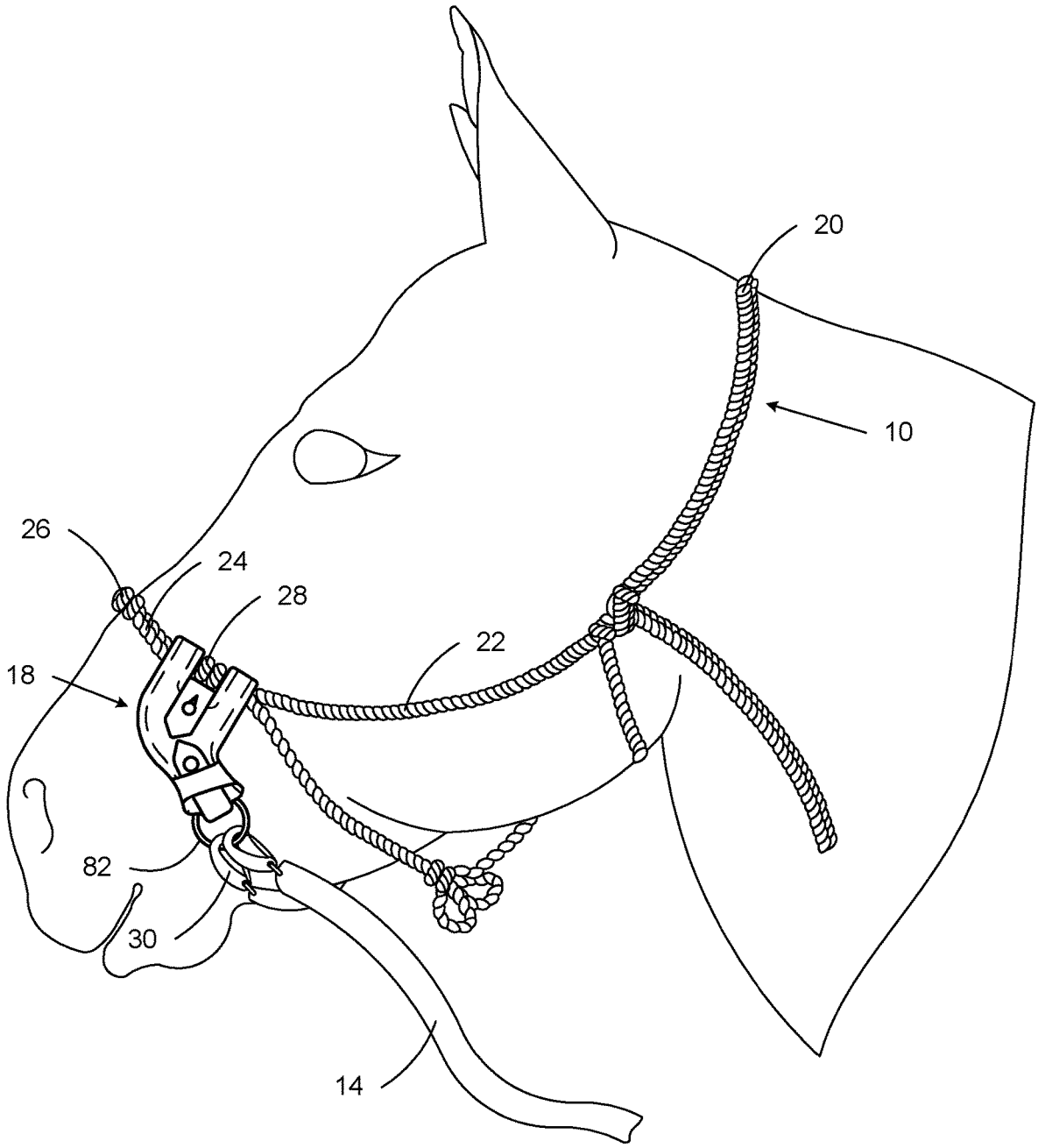
FIG. 7 is a diagram illustrating an exemplary implementation, in simplified form, of a left-side rope halter conversion attachment installed onto a rope halter that is fitted on a horse's head, where the rope halter conversion attachment includes a rein attachment portion including a rein attachment ring. This ring allows for attachment of many rein styles such as English and snap reins.

The rope halter conversion attachment implementations described herein provide a connection between a rope halter 10 that has been placed on a horse's head and the reins 12, 14, as shown in FIGS. 1 and 7. For Western style riding, one implementation of the rope halter conversion attachment 16 features a Western style bridle slobber strap that allows the rider to employ mecate style reins 12 or snap style reins (not shown). This implementation is shown in FIGS. 1-6. Alternatively, for English style reins or snap reins, one implementation of the rope halter conversion attachment 18 features a rein attachment portion with a rein attachment ring. To this the rider can attach many styles of reins including English style and snap reins 14. This implementation is shown in FIGS. 7-11.

Referring again to FIGS. 1 and 7, the rope halter 10 typically includes a crown piece 20, cheek piece 22 and nose band 24. The rope halter can be fashioned from a single piece of rope with knots to create the configuration shown in the figures. Additionally, knots can be placed to put pressure in key locations on the horse's face to improve communication, such as nose band knot 26. The rope halter conversion attachment 16, 18 advantageously allows riding commands to be imparted to the horse via the rope halter 10 by manipulation of the reins 12, 14. In particular, and as will be explained in more detail in the sections to follow, the rope halter conversion attachment 16, 18 redirects tension placed on the reins 12, 14 by the rider to put pressure on the knots tied into the halter (e.g., the nose band knot 26). These pressure focusing knots on the halter communicate nonverbal commands to the horse. If the reins were connected directly to the halter, for example on a lead loop typically used to tether the horse or on O-rings attached to the halter's cheek knots, applying tension using the reins would result in the halter being pulled up onto or twisting around the horse's face. This movement of the halter knots across the horse's face would blur the intended command signal and may not effectively communicate it to the animal. The rope halter conversion attachment implementations instead redirect the force of the reins to a downward force on the rope halter nose band.

Using a rope halter with the rope halter conversion attachment implementations described herein for bitless riding also has other advantages. For example, a rope halter is a relatively inexpensive piece of equipment that is already typically owned by many equestrians. Simple addition of the rope halter conversion attachment precludes the need to purchase a more expensive, special purpose bridles for riding bitless. In addition, when a rider wishes to both ride and tether the horse in the same outing (such as a during trail ride), only a rope halter is required when using the rope halter conversion attachment implementations described herein. There is no need to also carry a bitless bridle. Further, as will be appreciated from the more detailed description to follow, the rope halter conversion attachment implementations are easy to attach and detach from the rope halter and reins without tools, and there is no need to remove the rope halter from the horse (which is useful for tethering, leading or transporting the horse in a horse trailer). Alternately, the rope halter conversion attachment could be permanently affixed to a rope halter.

The rope halter conversion attachment implementations described herein further facilitate connection of reins to a rope halter in a safe, secure location and are manufactured with a unique geometry which transmits rein tension by pivoting in a leverage fashion. More particularly, referring again to FIGS. 1 and 7, the rope halter conversion attachment 16, 18 is designed to integrate with any common rope style halter 10 by folding around the halter's cheek piece 22 and nose band 24. The knot 28 (referred to as the cheek knot) at the junction of the halter's cheek piece 22 and nose band 24 is used to secure the rope halter conversion attachment 16, 18 in the proper location and orientation.

The rope halter conversion attachment implementations described herein form an angle between the halter's cheek knot and the point of attachment of the reins as will be described in more detail in the sections to follow. When rein tension is applied by the rider, this angle causes a pivoting motion that pulls on the nose band and creates pressure on the horse's nose. This pressure enhances the communication of nonverbal riding commands between the rider and the horse, particularly if the nose band has a pressure knot or knots 26 that overlie the top of the horse's nose.

Figure 2:
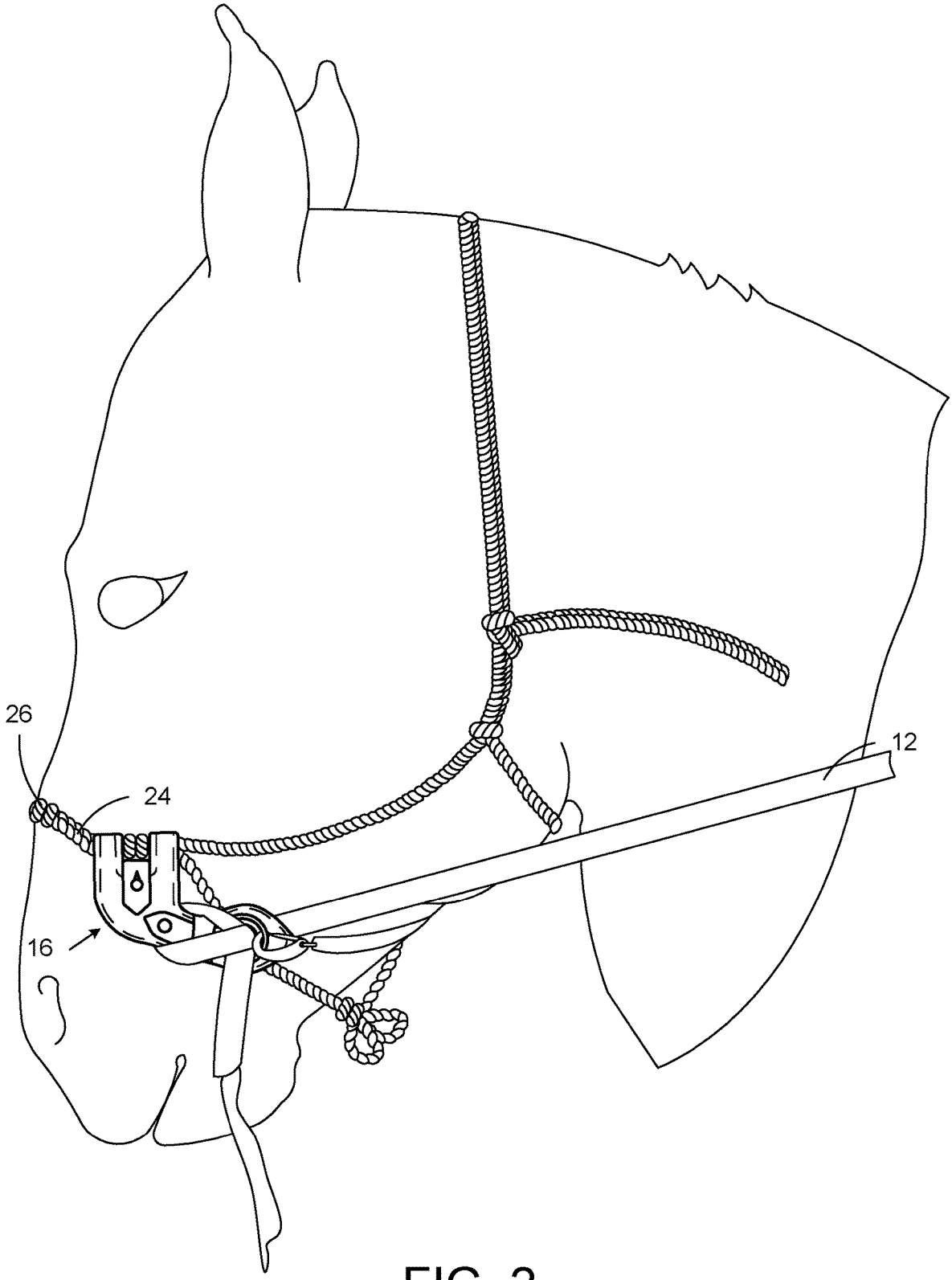
FIG. 2 is a diagram illustrating an exemplary implementation, in simplified form, of a left-side rope halter conversion attachment installed onto a rope halter that is fitted on a horse's head, where the rope halter conversion attachment includes a rein attachment portion resembling a Western style bridle slobber strap and where tension is being placed on the mecate style reins.

FIG. 1 shows the rope halter conversion attachment 16 installed in the proper position on the rope halter 10 on a horse. Metate reins 12 have been attached. There is no tension on the reins 12 in FIG. 1, as noted by the droop, and the horse's head is forward. In FIG. 2, tension has been applied by the reins 12 causing the rope halter conversion attachment 16 to pivot. The pivoting rope halter conversion attachment pulls on the nose band 24 of the rope halter and causes the halter's nose band knot 26 to put pressure on the horse's nose. The horse is trained to recognize this pressure as a command. For example, the horse can be trained to drop its head and arch its neck in response to the nose knot pressing on its nose, as shown in FIG. 2. This movement is sometimes called flexing at the pole. Of course, the horse can be trained to perform other tasks when pressure is applied to the nose band knot as well. For instance, the horse can be trained to stop or back up (and so on) when the nose band knot pressure is applied. FIG. 7 shows the rope halter conversion attachment 18 installed in the proper position on the rope halter 10 on a horse. Snap reins 14 have been attached in this example. There is no tension on the reins 14 in FIG. 7, as noted by the droop, and the horse's head is forward. When tension has been applied by the reins 14, the rope halter conversion attachment 18 pivots, in the same way as the exemplary implementation of FIG. 2, causing the halter's nose band knot 26 to put pressure on the horse's nose. The horse would then perform the action it has been trained to do when this pressure is applied.

The rope halter conversion attachment implementations described herein can be used singly (either on the right or left side of the horse's head), or as a pair. When used as a pair, one rope halter conversion attachment is attached to the halter on the left side of the horse's face (from the horse's perspective), and a second rope halter conversion attachment that is the mirror image copy of the left side rope halter conversion attachment is attached to the halter on the right side of the horse's face. It is noted that the description of the rope halter conversion attachment implementations provided heretofore, and in the sections to follow, as well as in the drawings, refer to the left-side version of the conversion attachment. The right-side version of the conversion attachment is the same, except that the components are reversed in a mirror image fashion. It is also noted that in scenarios where a pair of rope halter conversion attachments are used, an optional chin strap 30 (as seen in FIGS. 1 and 7) can be attached at one end to a ring on the right-side rope halter conversion attachment and the other end of the chin strap can be attached to a ring on the left-side rope halter conversion attachment. These rings will be described in greater detail in the sections to follow. The chin strap 30 is an additional stabilization method.

2.0 Rope Halter Conversion Attachment

In general, the rope halter conversion attachment is composed of a strap of strong flexible material such as leather, braided nylon, and so on. In one implementation, the rope halter conversion attachment is constructed of a heavy, full grain leather, harness grade stitching and corrosion proof hardware. The rope halter conversion attachment in its utilitarian form is folded.

Figure 3:
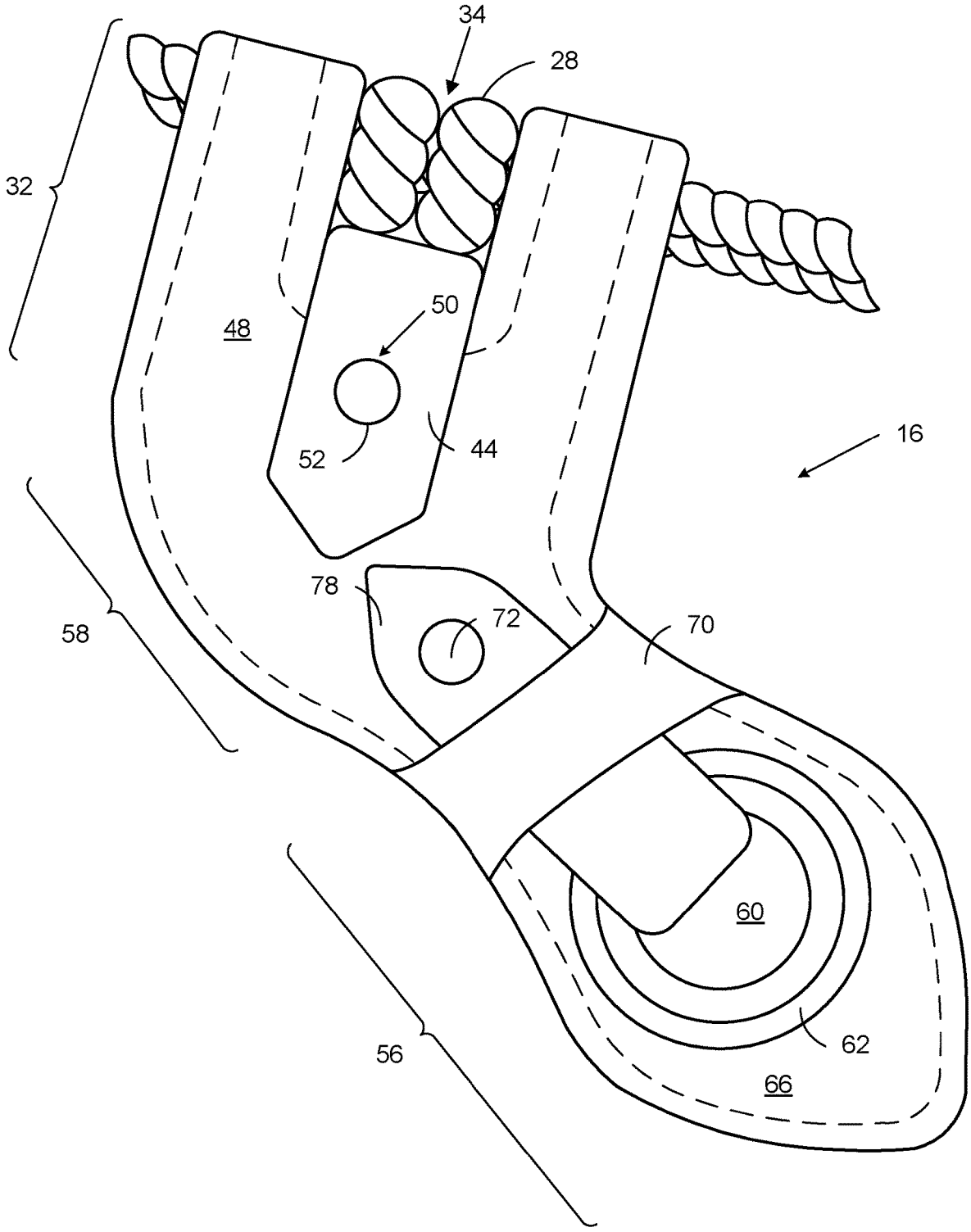
FIG. 3 is a diagram illustrating one implementation, in simplified form, of the left-side rope halter conversion attachment with the rein attachment portion resembling a Western style bridle slobber strap and showing it in the folded condition.
Figure 8:
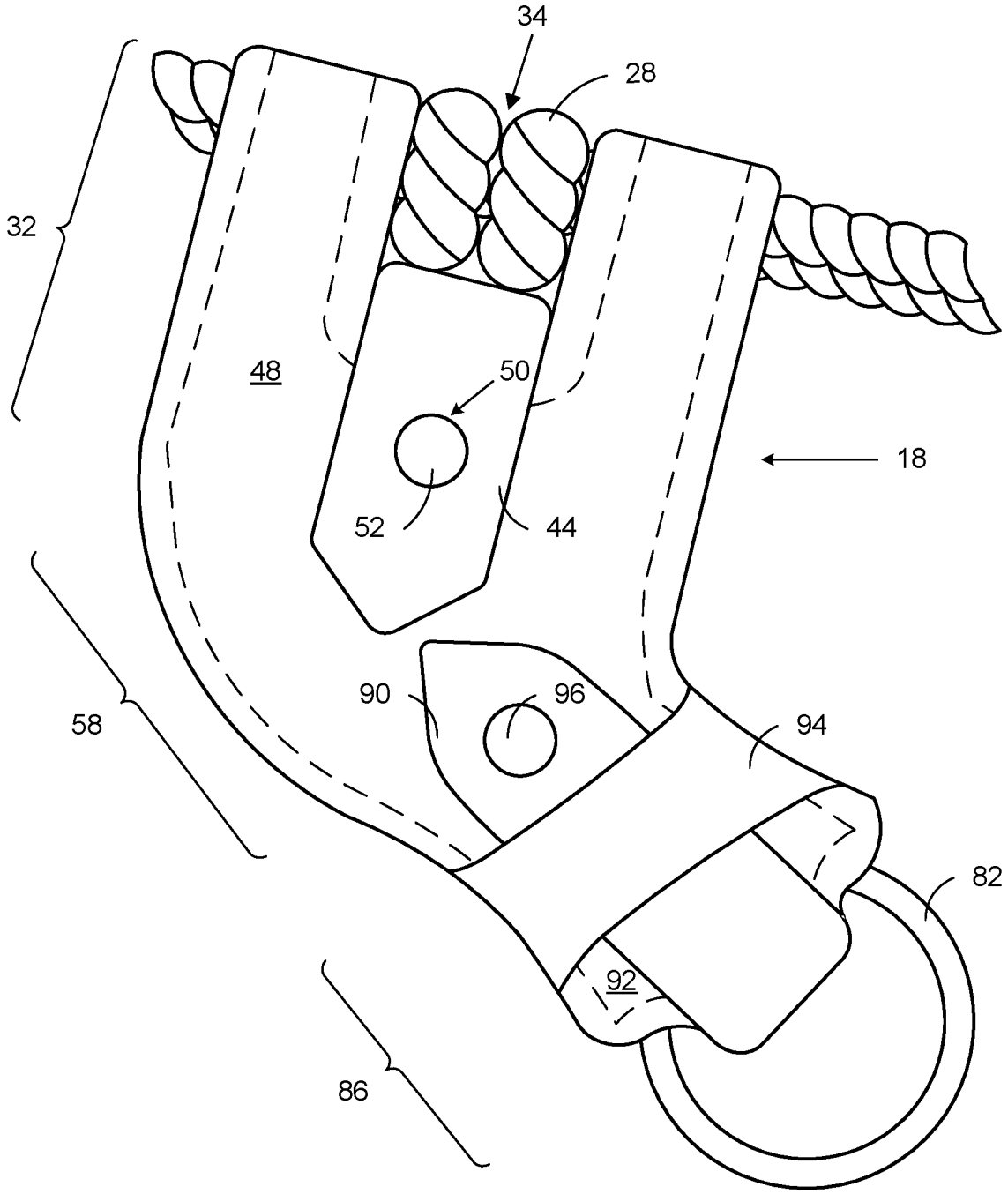
FIG. 8 is a diagram illustrating one implementation, in simplified form, of the left-side rope halter conversion attachment with the rein attachment portion including the rein attachment ring and showing it in the folded condition.
Figure 11:
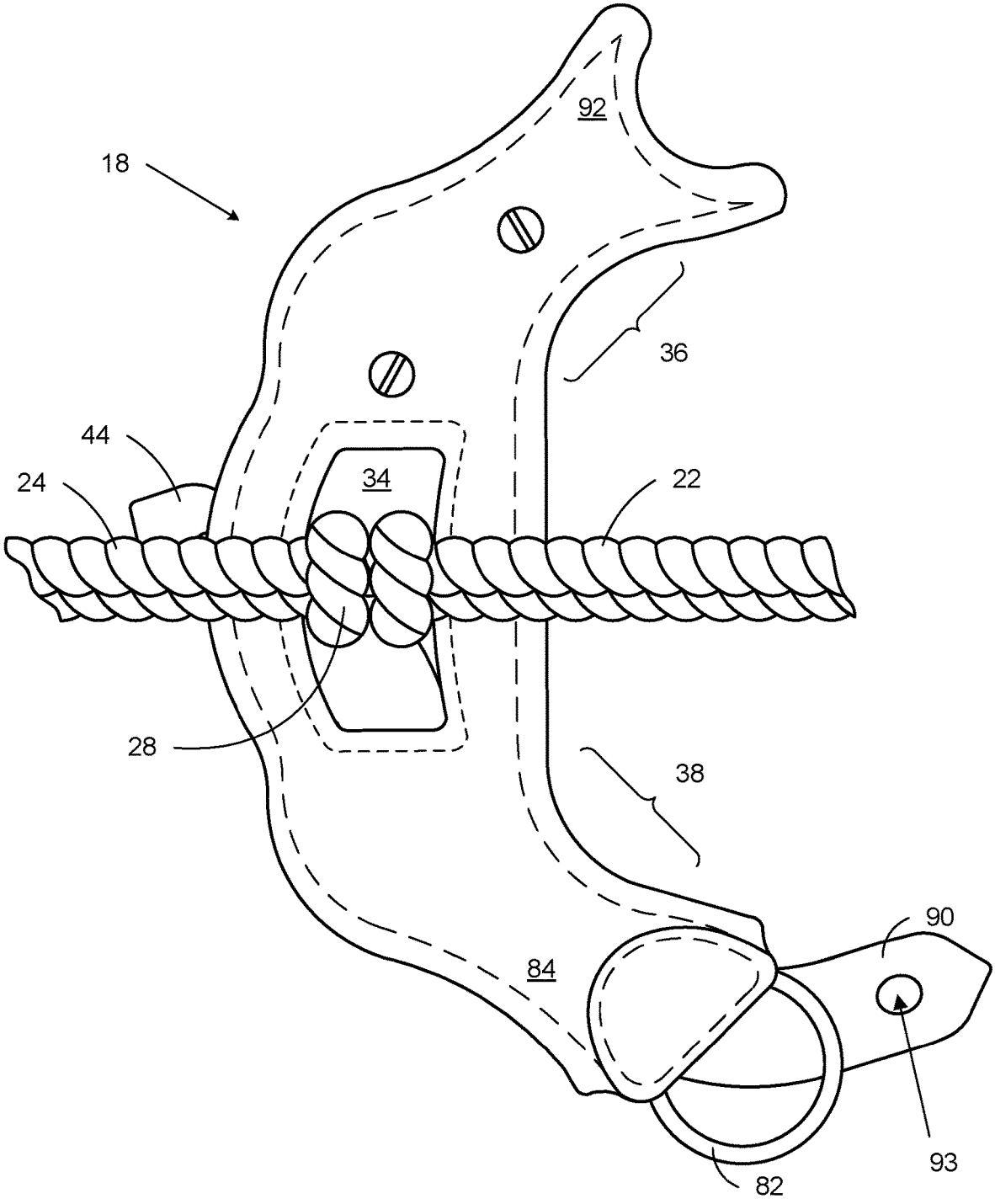
FIG. 11 is a diagram illustrating one implementation, in simplified form, of the left-side rope halter conversion attachment with the rein attachment portion including the rein attachment ring and showing its back side in the unfolded condition placed under the cheek piece and nose band of the rope halter with the halter's cheek knot in the rope halter conversion attachment's cheek knot slot.

Referring to the rope halter conversion attachment implementations depicted in FIGS. 3 and 8, a cheek knot capture slot 34 in the cheek knot capture portion 32 of the rope halter conversion attachment 16, 18 is employed to capture the cheek knot 28 of the rope halter. As best seen in FIGS. 6 and 11, the rope halter conversion attachment 16, 18 is placed under the halter's cheek piece 22 and nose band 24, with the back side of the attachment initially facing away from the horse's face, the angled lever portion halves 36, 38 of the rope halter conversion attachment pointed generally away from the horse's nose, and with the cheek knot 28 overlying the cheek knot capture slot 34. The lever portion half 36 of the rope halter conversion attachment is folded down and over the halter's cheek piece 22 and nose band 24. As best shown in FIGS. 3 and 8, after folding, the lever portion halves align with each other. In addition, the cheek knot 28 fills the cheek knot capture slot 34. This aids in holding the rope halter conversion attachment in place on the halter's cheek piece 22.

Figure 4:
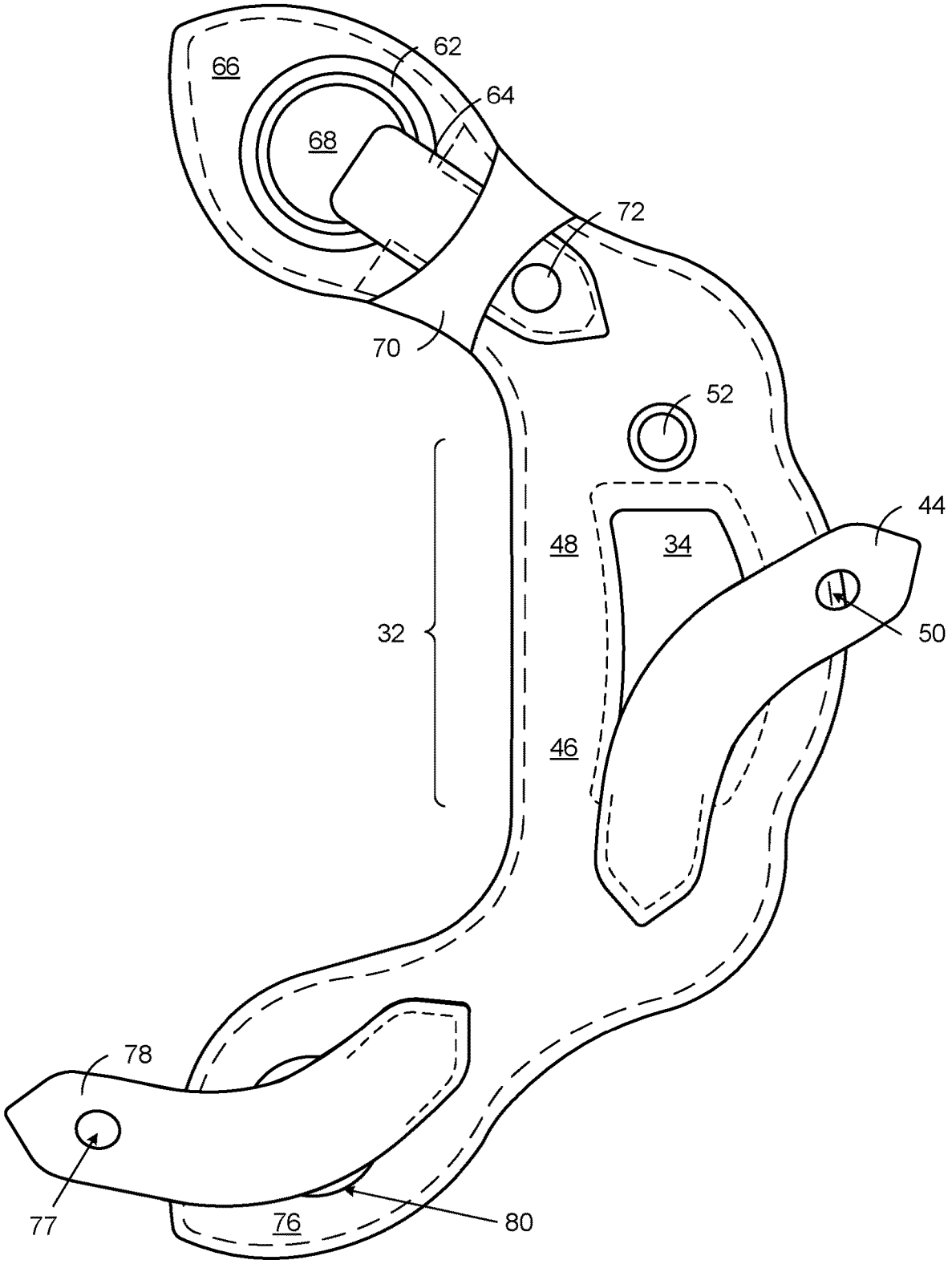
FIG. 4 is a diagram illustrating one implementation, in simplified form, of the left-side rope halter conversion attachment with the rein attachment portion resembling a Western style bridle slobber strap and showing its exterior side in the unfolded condition.
Figure 9:
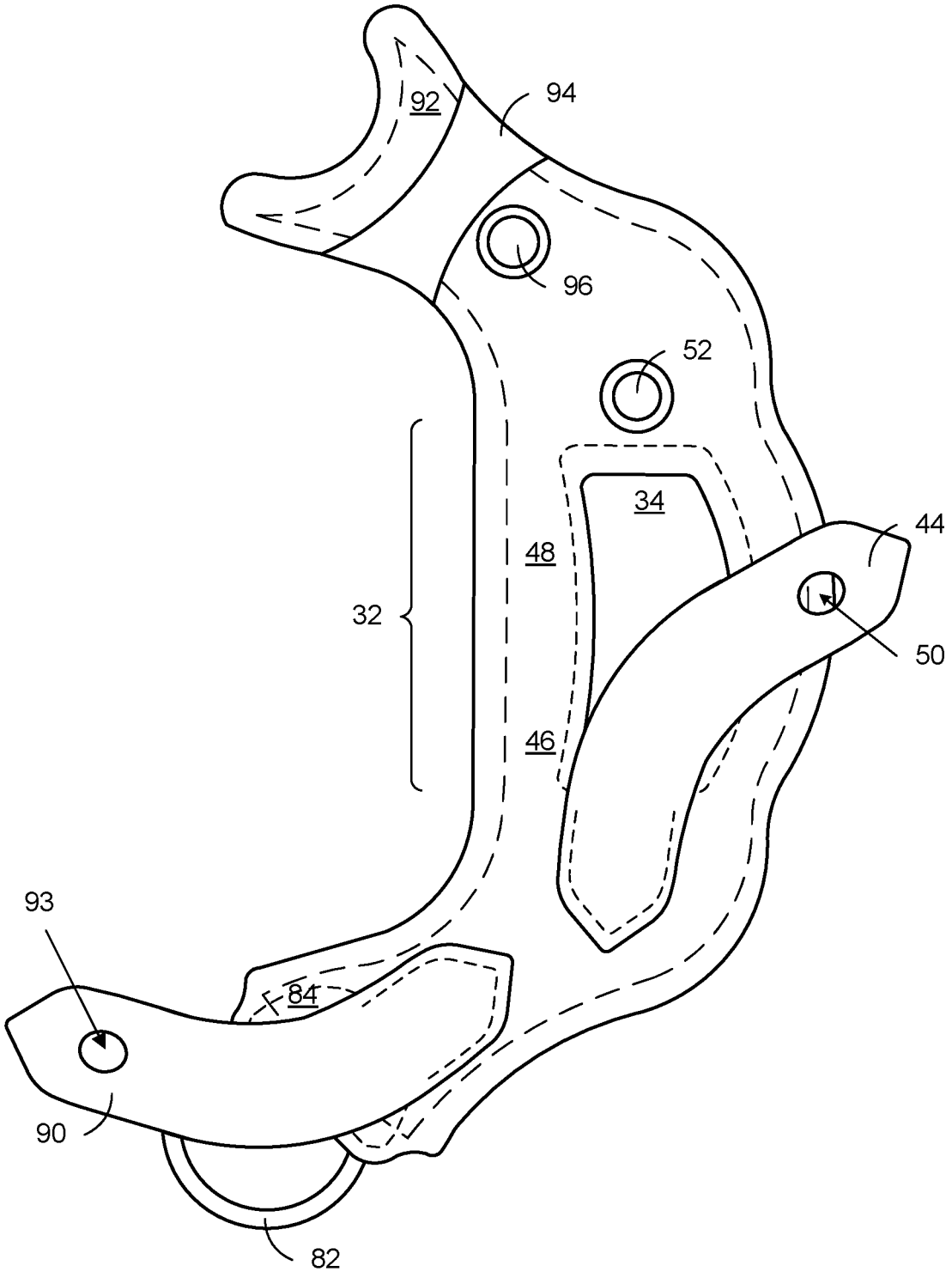
FIG. 9 is a diagram illustrating one implementation, in simplified form, of the left-side rope halter conversion attachment with the rein attachment portion including the rein attachment ring and showing its exterior side in the unfolded condition.
Figure 10:
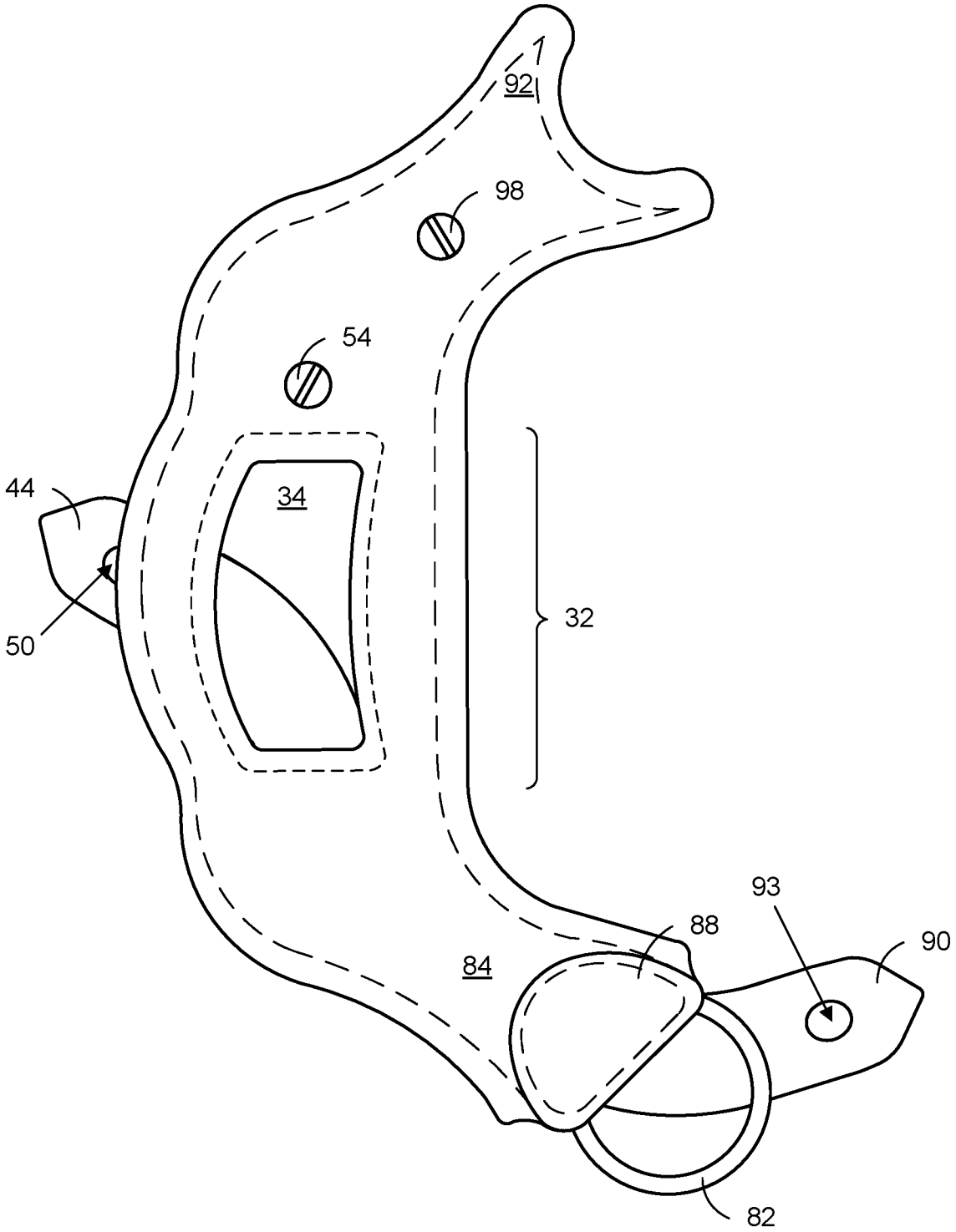
FIG. 10 is a diagram illustrating one implementation, in simplified form, of the left-side rope halter conversion attachment with the rein attachment portion including the rein attachment ring and showing its back side in the unfolded condition.

The rope halter conversion attachment can be held in its folded condition by any appropriate method that creates a secure but readily releasable connection. For example, hook-and-loop fasteners or snaps could be installed to hold the rope halter conversion attachment in its folded condition. In the depicted implementations of the rope halter conversion attachment in FIGS. 3-6 and 8-11, a strap method is employed. More particularly, the releasable connector that holds the inward facing part of the cheek knot capture portion to the outward facing part of the cheek knot capture portion whenever the rope halter conversion attachment is folded over the cheek knot, takes the form of a cheek knot capture slot latch strap 44. As best seen in FIGS. 4 and 9, the cheek knot capture slot latch strap 44 is stitched at its proximal end to the inward facing part 46 of the cheek knot capture portion of the rope halter conversion attachment adjacent a first end of the cheek knot capture slot 34. As best seen in FIGS. 3 and 8, when the rope halter conversion attachment is in its folded condition, the cheek knot capture slot latch strap 44 threads through the cheek knot capture slot 34 under the halter's cheek knot 28 and is releasably secured to the outward facing part 48 of the cheek knot capture portion of the rope halter conversion attachment adjacent a second end of the cheek knot capture slot. In the depicted versions (see FIGS. 4 and 9), the distal end of the strap 44 is sewn to the cheek knot capture portion 46. However, other attachment methods can be employed as well, such as gluing, riveting, and so on. The cheek knot capture slot latch strap 44 is secured via a hole 50 in the strap near its distal end and a button post 52 projecting from the outward facing part 48 of the cheek knot capture portion of the rope halter conversion attachment adjacent the second end of the cheek knot capture slot 34. More particularly, in one implementation, the button post is secured to the cheek knot capture portion 48 via a screw 54 (as best seen in FIGS. 5 and 10). However, other attachment methods can be employed as well. For example, but without limitation, instead of a screw and button, a protruding rivet, leather tie, and so on could interface with the hole 50 to secure the strap 44. Further, the hole and attaching structure could be replaced with a snap or hook-and-loop arrangement, among other releasable securing schemes, as desired. Regardless of what securing method is employed, the purpose of the strap 44 once secured is to hold the rope halter conversion attachment 16, 18 in its folded condition and to capture the halter's cheek knot 28 in the cheek knot capture slot 34.

As best seen in FIGS. 3 and 8, once installed on the rope halter 10, the cheek knot capture portion 32 of the rope halter conversion attachment projects from the cheek knot 28 toward the horse's mouth, and then forms an approximately 35 degree angle with the lever portion 58 of the rope halter conversion attachment. The lever portion 58 projects from the cheek knot capture portion 32 toward the bottom of the horse's mandible. While a 35 degree angle is believed to provide an optimum pivoting motion at the rope halter's cheek knot when tension is applied by the reins to the rope halter conversion attachment, it is not intended that the conversion attachment be limited to only this angle. Rather, any angle that provides a pivoting motion to the rope halter's cheek knot when tension is applied by the reins that allows riding commands to be adequately communicated to the horse can be employed.

2.1 Rein Attachment

Referring again to FIGS. 3 and 8, at the distal end of the lever portion 58 of the rope halter conversion attachment, there is a rein attachment portion 56, 86. While any configuration for the rein attachment portion can be employed, two options are depicted in the drawings. These options allow for a variety of reins to be attached, such as but not limited to mecate reins, English style, and snap reins. Referring to FIG. 3, one rein attachment portion 56 implementation includes a Western style bridle slobber strap configuration. This configuration has a rein attachment hole 60 that allows the rider to employ mecate style reins (as best seen in FIG. 1). The hole 60 is created by the alignment of the hole 68 in the outward facing rein attachment portion 66 and the hole 80 in the inward facing rein attachment portion 76 (as best seen in FIG. 5). To this end, the hole 60 has a diameter large enough to accommodate the mecate style reins. In addition, this implementation also includes a rein attachment ring 62 that reinforces the hole 60 for use with mecate style reins and allows the rider to employ snap style reins instead (not shown). The ring 62 is affixed to the outward facing side of the rein attachment portion 56. In the depicted version of FIG. 3, the ring 62 is round and made of a non-corrosive metal (such as stainless steel or brass). The ring 62 has an interior diameter that makes it slightly larger than the hole 60. It is not, however, intended that the rope halter conversion attachment implementations be limited to the foregoing hole and ring arrangement. For example, the hole, or ring, or both, can exhibit a different shape (e.g., square, rectangular, triangular, oval, and so on). The ring can also be made of a different material, such as plastic.

Referring to FIGS. 3 and 4, while the rein attachment ring 62 can be attached to the rein attachment portion 56 using any appropriate method, the depicted version employs a rein attachment ring strap 64. This strap 64 (which can be made of leather) is attached at its proximal end to the back side of the outward facing rein attachment portion 66 (as best seen in FIG. 5) of the rope halter conversion attachment adjacent a side of the rein attachment hole 68 nearest the proximal end of the outward facing rein attachment portion 66. In the depicted version, the rein attachment ring strap 64 is sewn to the outward facing rein attachment portion 66 on both its external side (see FIG. 4) and back side (see FIG. 5). However, other attachment methods can be employed as well, such as gluing, riveting, and so on. As best seen in FIG. 4, the rein attachment ring strap 64 passes through the rein attachment hole 68 and over the rein attachment ring 62 where it is secured to the outward facing rein attachment portion 66 of the rope halter conversion attachment adjacent a side of the rein attachment hole nearest the proximal end of the outward facing rein attachment portion. In one implementation, a button post 72 projects from the outward facing rein attachment portion 66 of the rope halter conversion attachment adjacent a side of a rein attachment hole 68 nearest the proximal end of the outward facing rein attachment portion. More particularly, in one implementation, this button post is secured to the outward facing rein attachment portion 66 via a screw 74 (as best seen in FIG. 5). In this version, the screw 74 is installed through the strap 64 from the back side of the outward facing rein attachment portion 66, then through the rein attachment portion itself, and then through the strap on the external side of the outward facing rein attachment portion. However, other attachment methods can be employed as well. For example, but without limitation, instead of a screw and button, a protruding rivet, and so on could be used. Further, as best seen in FIG. 4, the rein attachment ring strap 64 passes under a retaining strap 70 that extends perpendicularly across the exterior side of the outward facing rein attachment portion 66.

The rein attachment portion also includes a releasable rein attachment connector that holds the inward facing rein attachment portion to the outward facing rein attachment portion whenever the rope halter conversion attachment is folded over the cheek knot. More particularly, referring again to FIGS. 4 and 5, in one implementation, the inward facing rein attachment portion implementation 76 includes a releasable rein attachment latch strap 78. The strap 78 (which can be made of leather) is stitched at its proximal end to the exterior side of the inward facing rein attachment portion 76 of the rope halter conversion attachment adjacent a side of the rein attachment hole 80 nearest the proximal end of the inward facing rein attachment portion. In the depicted version best seen in FIG. 4, the strap 78 is sewn to the inward facing rein attachment portion 76. However, other attachment methods can be employed as well, such as gluing, riveting, and so on. As best seen in FIGS. 3 and 4, once the outward facing rein attachment portion 66 is folded over the rope halter and aligned with inward facing rein attachment portion, as described previously, the rein attachment latch strap 78 is threaded through the rein attachment hole 60, under the retaining strap 70, and is releasably secured to the outward facing rein attachment portion 66 of the rope halter conversion via a hole 77 near the distal end of the strap and the previously described button post 72. As such, the rein attachment latch strap 78 overlies rein attachment ring strap 64. It is noted that other attachment methods can be employed to releasably secured the rein attachment latch strap to the outward facing rein attachment portion of the rope halter conversion. For example, but without limitation, a snap or hook and loop arrangement, among other releasable securing schemes could be employed as desired.

FIGS. 7-11 show an alternate rein attachment portion implementation. This configuration has a rein attachment ring 82 that allows the rider to employ many styles of reins such as English style reins or snap reins. This ring 82 extends from the inward facing rein attachment portion 84 and has an interior diameter large enough to easily attach the hook of snap style reins. As best seen in FIG. 10, the ring 82 is affixed to the inward facing rein attachment portion 84 and extends therefrom. In the depicted version, the ring 82 is round and made of a non-corrosive metal (such as stainless steel or brass). It is not, however, intended that the rope halter conversion attachment implementations be limited to the foregoing ring arrangement. For example, ring can exhibit a different shape (e.g., square, rectangular, triangular, oval, and so on). The ring can also be made of a different material, such as plastic.

As best seen in FIG. 10, while the rein attachment ring 82 can be attached to the rein attachment portion using any appropriate method, the depicted version employs a rein attachment ring strap 88. This strap 88 (which can be made of leather) is integral with the inner facing rein attachment portion 84 and extends therefrom. As depicted in FIG. 10, the rein attachment ring strap 88 passes through the rein attachment ring 82 where it is secured to the back side of the inward facing rein attachment portion 84 of the rope halter conversion attachment. In the implementation best depicted in FIG. 10, the distal end of the rein attachment ring strap 88 is sewn to the back side of the inward facing rein attachment portion 84 of the rope halter conversion attachment, although other attachment methods can be employed as well, such as gluing, riveting, and so on. In an alternate implementation (not shown), the rein attachment ring strap is a separate piece attached at its proximal end to the exterior side of the inward facing rein attachment portion of the rope halter conversion attachment. The proximal end of the rein attachment ring strap in this latter implementation can be stitched to the exterior side of the inward facing rein attachment portion, however other attachment methods can be employed as well such as gluing, riveting, and so on.

The rein attachment portion also includes a releasable rein attachment connector that holds the inward facing rein attachment portion to the outward facing rein attachment portion whenever the rope halter conversion attachment is folded over the cheek knot. More particularly, referring to FIGS. 9 and 10, in one implementation, the inward facing rein attachment portion 84 includes a releasable rein attachment latch strap 90. The strap 90 (which can be made of leather) is attached at its proximal end to the exterior side of the inward facing rein attachment portion 84 of the rope halter conversion attachment (as best seen in FIG. 9). In the depicted version, the strap 90 is sewn to the inward facing rein attachment portion 84. However, other attachment methods can be employed as well, such as gluing, riveting, and so on. As best seen in FIG. 8, once the outward facing rein attachment portion 92 is folded over the rope halter and aligned with inward facing rein attachment portion, as described previously, the rein attachment latch strap 90 is threaded through the rein attachment ring 82, under the retaining strap 94, and then is releasably secured to the outward facing rein attachment portion 92 of the rope halter conversion via a hole at the distal end of the strap 90. In one implementation, as best depicted in FIGS. 9 and 10, the rein attachment strap 90 is secured using a button post 96 projecting from the outward facing rein attachment portion 92 of the rope halter conversion attachment via the hole 93 in the strap at its distal end. More particularly, in one implementation, this button post is secured to the outward facing rein attachment portion 92 via a screw 98 (as best seen in FIG. 10). However, other attachment methods can be employed as well. For example, but without limitation, instead of a screw and button, a protruding rivet, leather tie, and so on could be used to secure the rein attachment ring strap. Still further, the screw and button could be replaced a snap or hook and loop arrangement, among other releasable securing schemes could be employed, as desired.

3.0 Other Advantages and Implementations

While the rope halter conversion attachment has been described in more detail by specific reference to implementations thereof, it is understood that variations and modifications thereof can be made without departing from the true spirit and scope of the attachment.

It is further noted that any or all of the implementations that are described in the present document and any or all of the implementations that are illustrated in the accompanying drawings may be used and thus claimed in any combination desired to form additional hybrid implementations. In addition, although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What has been described above includes example implementations. It is, of course, not possible to describe every conceivable combination of components or methodologies for purposes of describing the claimed subject matter, but one of ordinary skill in the art may recognize that many further combinations and permutations are possible. Accordingly, the claimed subject matter is intended to embrace all such alterations, modifications, and variations that fall within the spirit and scope of the appended claims.

Wherefore, what is claimed is:

1. A rope halter conversion attachment for attaching reins to a rope halter fitted on the head of a riding animal in a way that allows a rider to communicate nonverbal commands to the animal by applying tension to the reins, comprising:

a cheek knot capture portion comprising a cheek knot capture slot which captures a cheek knot on the rope halter formed at the juncture of a nose band and cheek piece of the halter whenever the rope halter conversion attachment is folded over the cheek knot, and a releasable connector that holds an inward facing part of the cheek knot capture portion to an outward facing part of the cheek knot capture portion whenever the rope halter conversion attachment is folded over the cheek knot;

an inward facing lever portion which extends away from the inward facing part of the cheek knot capture portion at a prescribed angle;

an outward facing lever portion which extends away from the outward facing part of the cheek knot capture portion at the prescribed angle, wherein whenever the rope halter conversion attachment is folded over the cheek knot, the inward and outward facing lever portions align with each other and together point toward to bottom of the animal's mandible;

an inward facing rein attachment portion which extends away from a distal end of the inward facing lever portion; and an outward facing rein attachment portion which extends away from a distal end of the outward facing lever portion, wherein whenever the rope halter conversion attachment is folded over the cheek knot, the inward and outward facing rein attachment portions align with each other and are used to connect the reins to the rope halter conversion attachment.

2. The rope halter conversion attachment of claim 1, wherein the releasable connector that holds the inward facing part of the cheek knot capture portion to the outward facing part of the cheek knot capture portion whenever the rope halter conversion attachment is folded over the cheek knot, comprises, a cheek knot capture slot latch strap which is attached at a proximal end to the inward facing part of the cheek knot capture portion of the rope halter conversion attachment adjacent a first end of the cheek knot capture slot, and which threads through the cheek knot capture slot under the halter's cheek knot and is releasably secured to the outward facing part of the cheek knot capture portion of the rope halter conversion attachment adjacent a second end of the cheek knot capture slot.

3. The rope halter conversion attachment of claim 2, wherein the cheek knot capture slot latch strap is releasably secured to the outward facing part of the cheek knot capture portion of the rope halter conversion attachment adjacent the second end of the cheek knot capture slot via a hole through the strap near its distal end and a button post, said button post projecting from the outward facing part of the cheek knot capture portion of the rope halter conversion attachment adjacent the second end of the cheek knot capture slot.

4. The rope halter conversion attachment of claim 3, wherein the button post projecting from the outward facing part of the cheek knot capture portion of the rope halter conversion attachment adjacent the second end of the cheek knot capture slot is secured to the cheek knot capture portion via a screw.

5. The rope halter conversion attachment of claim 1, wherein the inward facing and outward facing rein attachment portions each comprise a hole which align with one another whenever the rope halter conversion attachment is folded over the cheek knot to form a rein attachment hole which is used to connect mecate style reins to the rope halter conversion attachment.

6. The rope halter conversion attachment of claim 5, further comprising a rein attachment ring which is affixed to the outward facing rein attachment portion and surrounds the rein attachment hole, said rein attachment ring reinforcing the rein attachment hole and further allowing snap style reins to the connected to the rope halter conversion attachment.

7. The rope halter conversion attachment of claim 6, further comprising a rein attachment ring strap that affixes the rein attachment ring to the outward facing rein attachment portion, said rein attachment ring strap is attached at a proximal end to a back side of the outward facing rein attachment portion of the rope halter conversion attachment adjacent a side of the rein attachment hole nearest the proximal end of the outward facing rein attachment portion, and threads through the rein attachment hole and over the rein attachment ring where it is secured to the outward facing rein attachment portion of the rope halter conversion attachment adjacent a side of the rein attachment hole nearest the proximal end of the outward facing rein attachment portion.

8. The rope halter conversion attachment of claim 5, further comprising a releasable rein attachment connector that holds the inward facing rein attachment portion to the outward facing rein attachment portion whenever the rope halter conversion attachment is folded over the cheek knot, said releasable rein attachment connector, comprising, a rein attachment latch strap which is attached at a proximal end to the inward facing rein attachment portion of the rope halter conversion attachment adjacent a side of a rein attachment hole nearest the proximal end of the inward facing rein attachment portion, and which threads through the rein attachment hole and is releasably secured to the outward facing rein attachment portion of the rope halter conversion attachment adjacent a side of the rein attachment hole nearest the proximal end of the outward facing rein attachment portion.

9. The rope halter conversion attachment of claim 8, wherein the rein attachment latch strap is releasably secured to the outward facing rein attachment portion of the rope halter conversion attachment adjacent a side of a rein attachment hole nearest the proximal end of the outward facing rein attachment portion via a hole through the strap near its distal end and a button post, said button post projecting from the outward facing rein attachment portion of the rope halter conversion attachment adjacent the side of a rein attachment hole nearest the proximal end of the outward facing rein attachment portion.

10. The rope halter conversion attachment of claim 9, wherein the button post projecting from the outward facing rein attachment portion of the rope halter conversion attachment adjacent the side of a rein attachment hole nearest the proximal end of the outward facing rein attachment portion is secured to the rein attachment portion via a screw.

11. The rope halter conversion attachment of claim 9, further comprising a retaining strap which extends perpendicularly across the outward facing rein attachment portion, said retaining strap overlying the rein attachment latch strap between the rein attachment hole and the button.

12. The rope halter conversion attachment of claim 1, further comprising a rein attachment ring which is affixed to the inward facing rein attachment portion and extends therefrom, said rein attachment ring allowing reins to the connected to the rope halter conversion attachment.

13. The rope halter conversion attachment of claim 12, further comprising a rein attachment ring strap that affixes the rein attachment ring to the inward facing rein attachment portion, said rein attachment ring strap extends from and is an integral part of the distal end of the inward facing rein attachment portion of the rope halter conversion attachment, and threads through and over the rein attachment ring and is secured to a back side of the inward facing rein attachment portion of the rope halter conversion attachment.

14. The rope halter conversion attachment of claim 12, further comprising a releasable rein attachment connector that holds the inward facing rein attachment portion to the outward facing rein attachment portion whenever the rope halter conversion attachment is folded over the cheek knot, said releasable rein attachment connector, comprising, a rein attachment latch strap which is attached at a proximal end to a distal end of the inward facing rein attachment portion of the rope halter conversion attachment, and which threads through the rein attachment ring and is releasably secured to the outward facing rein attachment portion of the rope halter conversion attachment.

15. The rope halter conversion attachment of claim 14, wherein the rein attachment latch strap is releasably secured to the outward facing rein attachment portion of the rope halter conversion attachment via a hole through the strap near its distal end and a button post, said button post projecting from the outward facing rein attachment portion of the rope halter conversion attachment.

16. The rope halter conversion attachment of claim 15, wherein the button post projecting from the outward facing rein attachment portion of the rope halter conversion attachment is secured to the rein attachment portion via a screw.

17. The rope halter conversion attachment of claim 15, further comprising a retaining strap which extends perpendicularly across the outward facing rein attachment portion, said retaining strap overlying the rein attachment latch strap.

* * * * *